United States Patent [19]

Caspers et al.

[11] Patent Number: 4,457,834

[45] Date of Patent: Jul. 3, 1984

[54] RECOVERY OF HYDROGEN

[75] Inventors: John Casper, Basking Ridge, Rinaldo Kramer, Montclair, both of N.J.

[73] Assignee: Lummus Crest, Inc., Bloomfield, N.J.

[21] Appl. No.: 544,716

[22] Filed: Oct. 24, 1983

[51] Int. Cl.[3] ..... C10G 49/22

[52] U.S. Cl. ..... 208/143; 208/100; 208/102; 208/103

[58] Field of Search ..... 208/100, 102, 103, 143, 208/213, 108

[56] References Cited

U.S. PATENT DOCUMENTS

| | | | |
|---|---|---|---|
| 3,101,380 | 8/1963 | Hariu | 208/100 |
| 3,444,072 | 5/1969 | Leman | 208/102 |
| 3,546,099 | 12/1970 | Sutherland | 208/103 |
| 3,607,726 | 9/1971 | Hallman | 208/102 |
| 3,666,658 | 5/1972 | Hallman | 208/103 |
| 4,159,937 | 7/1979 | Scott | 208/102 |
| 4,362,613 | 12/1982 | Maclean | 208/102 |
| 4,364,820 | 12/1982 | De Graff et al. | 208/102 |

*Primary Examiner*—Delbert E. Gantz
*Assistant Examiner*—Anthony McFarlane
*Attorney, Agent, or Firm*—Elliot M. Olstein

[57] ABSTRACT

Unreacted hydrogen contained in the gaseous effluent from a high pressure hydrogenation process is reduced in pressure, followed by purification of the hydrogen at the lower pressure, and recompression to a high pressure for use in a hydrogenation process. Liquid effluent is also reduced in pressure, hydrogen stripped therefrom, and combined with the recovered hydrogen gas at the lower pressure for purification.

28 Claims, 1 Drawing Figure

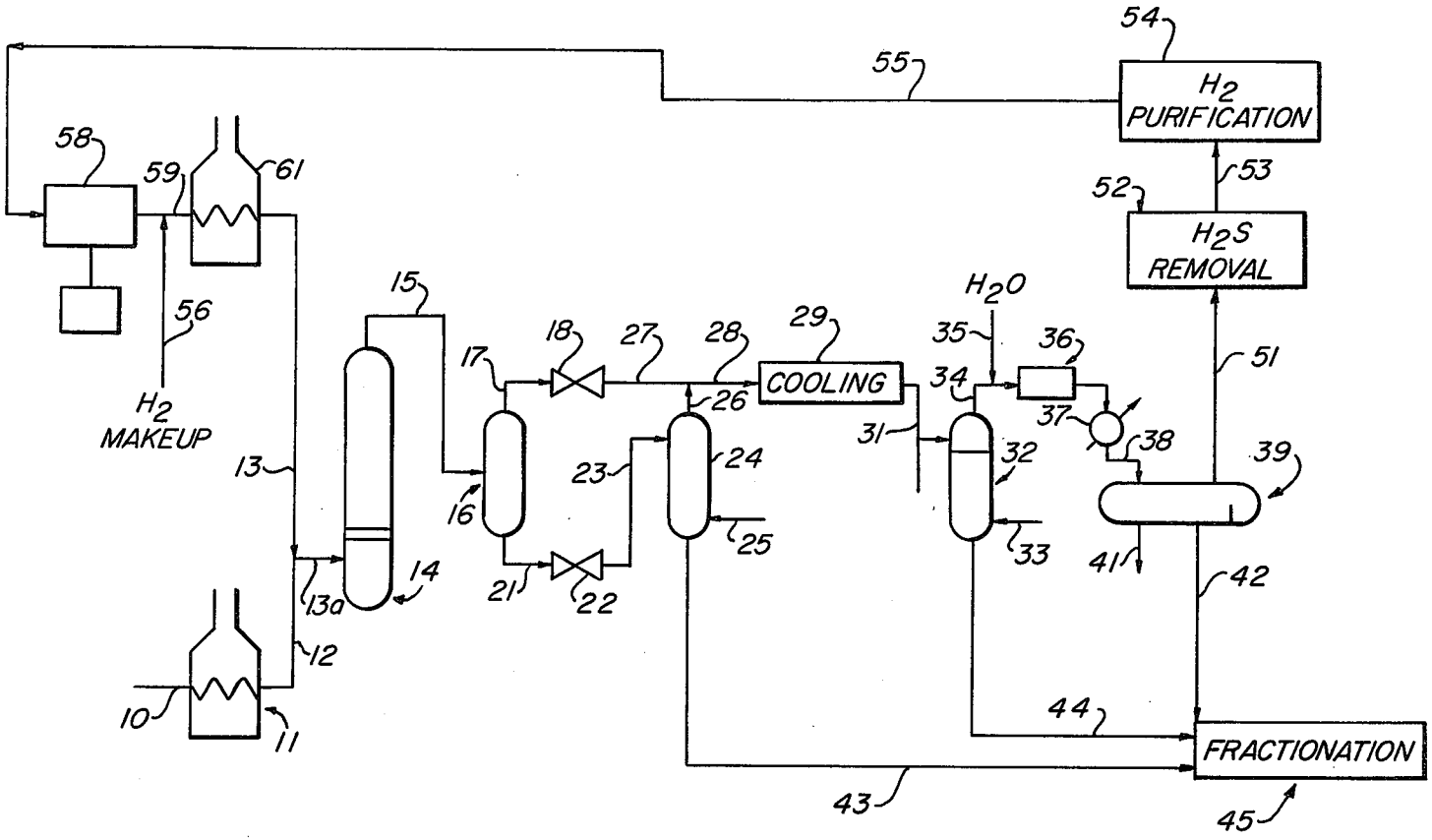
H2 PURIFICATION
H2S REMOVAL
FRACTIONATION
COOLING
H2O
H2 MAKEUP

RECOVERY OF HYDROGEN

This invention relates to the recovery of hydrogen, and more particularly, to the recovery of a hydrogen gas from a high pressure hydrogenation process.

In many processes, where a hydrocarbon containing feed is subject to a hydrotreating operation, such as for example: hydrogenation, hydrodesulfurization, hydrocracking and the like, at an elevated pressure, a gaseous effluent is produced which contains unreacted hydrogen. In order to provide for effective utilization of hydrogen, in most cases the unreacted hydrogen in the effluent is recovered as a recycle gas for reuse in the process.

Thus, for example, U.S. Pat. No. 3,444,072 discloses a process for recovering a hydrogen recycle gas wherein the effluent from a hydrogenation process is separated into liquid and gas portions, at the reaction temperature and pressure, with the gas portion, which includes recycle hydrogen, being treated and maintained at the elevated pressure for eventual recycle to the hydrogenation process. Additional hydrogen is recovered from the liquid portion by flashing the liquid portion to an intermediate pressure.

Although such a process provides for a recycle of hydrogen, while minimizing loss of hydrogen, there is a need for improvements in the process for recovering hydrogen from a high pressure hydrogenation process.

In accordance with one aspect of the present invention, there is provided an improvement in a process for hydrogenating a hydrocarbon feed wherein there is recovered in the hydrogenation process a gas containing unreacted hydrogen and impurities at a high pressure followed by reducing the pressure of the gas, purification of the gas at the reduced pressure, and pressuring the gas to an elevated pressure for use in a hydrogenation process.

More particularly, the gas containing unreacted hydrogen and impurities, which is at an elevated pressure of at least 1,000 psig is treated so as to reduce the pressure of the gas to a pressure which is at least 200 psi less than the elevated pressure and which is not in excess of 1500 psig. In general, the gas is reduced to a pressure of no greater than 800 psig, and preferably no greater than 600 psig. In general, the pressure is not reduced to a value of below 15 psig, with in most cases, the pressure being reduced to a value in the order of from 150 to 600 psig. It is to be understood that in the case of hydrogenation processes which are operated at pressures in the order of 1800 to 3000 psig and higher, some of the advantages of the present invention can be achieved by reducing the pressure of the gas to a value which is higher than the preferred upper limit of 800 psig, but no higher than 1500 psig; however, in most cases, the pressure is reduced to a value which does not exceed 800 psig and preferably does not exceed 600 psig so as to achieve the full advantages of the present invention.

The gas, at such lower pressure, is then purified to provide a hydrogen gas containing at least 70% by volume, of hydrogen, followed by repressuring the hydrogen gas to a pressure such that the gas can be used in a hydrogenation process (either the hydrogenation process from which the gas is derived and/or another hydrogenation process). Thus, contrary to prior art procedures, the gas recovered from the hydrogenation, which includes hydrogen, and which is at the elevated pressure employed in the hydrogenation process is subjected to a pressure reduction, followed by purification of the gas at such lower pressure and recompression of the purified gas to the pressure prevailing in a hydrogenation process in which the gas is to be used; i.e., the gas is pressurized to a pressure of at least 1000 psig and which is at least 200 psig greater than the pressure at which the gas was purified.

In accordance with a preferred embodiment of the invention, the liquid portion of the hydrogenation effluent, which is also at an elevated pressure (in particular, a pressure of at least 1,000 psig) is treated so as to reduce the pressure of the liquid to a pressure which corresponds to the pressure to which the hydrogen gas has been reduced. Such pressure reduction, which is preferably combined with a stripping operation results in additional hydrogen recovery. The hydrogen recovered from the liquid may be combined with the hydrogen gas previously separated from the effluent for purification.

The liquid and vapor portions of the hydrogenation effluent may be separated prior to the pressure reduction, in which case, the vapor and liquid portions are subjected to such pressure reduction, as separate streams. In the alternative, the liquid and vapor portions may be recovered at an elevated pressure in admixture with each other, and the vapor-liquid combination subjected to the reduction of pressure, as hereinabove described, followed by separation of the vapor and liquid portions.

It is to be understood that the pressure reduction of the separate gas and liquid portions or the combined portions may be accomplished in one or more stages so as to achieve the lower pressure, as herinabove defined, at which the hydrogen is purified.

The hydrogen gas which is to be purified at the lower pressure generally includes as impurities one or more of ammonia, hydrogen sulfide, carbon oxide(s), and hydrocarbons. The gas may be purified in one or more stages depending on the impurities which are present and may include one or more known techniques, such as, acid gas absorption, hydrocarbon adsorption, carbon oxide absorption, etc. In general, the purification is operated so as to provide a gas containing at least 70% hydrogen, and preferably at least 90% hydrogen, by volume. In most cases, it is possible to purify the gas so as to obtain a hydrogen gas containing 99+% of hydrogen.

A preferred technique for purification includes pressure swing adsorption of a type known in the art. Such a pressure swing absorption system is based on the principle of adsorbing impurities onto an adsorbent medium at a certain pressure, and regenerating the saturated adsorbent medium through depressuring and purging the contaminants from the adsorbent medium. The procedure employs rapid cycle operation and consists of the following four basic steps: adsorption, depressurization, purge at low pressure, and repressurization. Such a technique is described in Hydrocarbon Processing, March 1983, Page 91, "Use Pressure Swing Adsorption For Lowest Costs Hydrogen" Allen M. Watson.

Although the gas is preferably purified by pressure swing adsorption, it is to be understood that it is possible to effect purification of the gas so as to provide a hydrogen recycle stream by other procedures, such as cryogenics, membrane separation, etc.

The procedure of the present invention for recovery of a hydrogen gas from an effluent from a hydrogenation process is applicable to a wide variety of hydrogenation processes including hydrodesulfurization, hydrocracking, hydrodealkylation and other hydrotreating operations. The process has particular applicability to a process for hydrogenating high boiling hydrocarbon materials derived from either petroleum, bitumen or coal sources. The present invention has particular applicability to a process in which the hydrogenation of a hydrocarbon is accomplished in an expanded (ebullated) bed catalytic hydrogenation zone of a type known in the art. Thus, as known in the art, such hydrogenation is accomplished by use of an expanded or ebullated catalyst bed at temperatures in the order of from about 650° F. to about 900° F. and at operating pressures of at least 1000 psig, with the maximum operating pressure generally being no greater than about 4000 psig (most generally from 1800 to 3000 psig). The catalyst which is employed is generally one of a wide variety of catalysts which are known to be effective for hydrogenation of higher boiling materials, and as representative examples of such catalysts, there may be mentioned: cobalt-molybdate, nickel-molybdate, cobalt-nickel-molybdate, tungsten-nickel sulfide, tungsten sulfide, etc., with such catalysts generally being supported on a suitable support, such as alumina or silica-alumina.

In general, the feed to such a process is one which has high boiling components. In general, such a hydrocarbon feed has at least 25%, by volume, of material boiling above 950° F. Such feed may be derived from either petroleum and/or bitumen and/or coal sources, with the feed generally being a petroleum residuum, such as atmospheric tower bottoms, vacuum tower bottoms, heavy crudes and tars containing small amounts of materials boiling below 650° F., solvent refined coal; bitumens, such as tar sands, shale oil, pyrolysis liquids, etc. The selection of a suitable feedstock is deemed to be within the scope of those skilled in the art, and as a result, no further details in this respect are deemed necessary for a complete understanding of the present invention.

Although the above is exemplary of hydrogenation processes and hydrogenation feeds, the scope of the invention is not limited thereto in that the invention is generally applicable to the hydrogenation of hydrocarbons for any purpose at pressures of at least 1000 psig.

The invention will be further described with respect to the accompanying drawings wherein:

The drawing is a simplified schematic flow diagram of an embodiment of the present invention.

It is to be understood, however, that the scope of the invention is not to be limited to the flow diagram shown in the drawing.

Referring now to the drawing, a feed to be hydrogenated, in line 10, is heated in heater 11, and the heated hydrocarbon feed in line 12 is combined with hydrogen in line 13, obtained as hereinafter described. The combined stream in line 13*a* is introduced into a hydrogenation reactor, schematically generally indicated as 14.

The hydrogenation reactor 14 is preferably an ebullated bed type of reactor, and the hydrogenation is accomplished at conditions of the type hereinabove described.

The hydrogenation effluent, containing vapor and liquid portions, is withdrawn from hydrogenation reactor 14 through line 15, and introduced into a gas-liquid separator schematically generally indicated as 16. The gas liquid separator 16 is operated at a high pressure and high temperature, with the separator 16 generally being operated at a pressure of at least 1000 psig, and a temperature of at least 650° F. In general, the pressure and temperature of the high pressure high temperature separator 16 is essentially the temperature and pressure prevailing in the reactor 14.

Although the embodiment of the drawing is particularly directed to use of a separate vessel 16 for accomplishing separation of the vapor and liquid portions of the effluent, it is to be understood that such separation could be accomplished within the recator 14, in which case, there is withdrawn from the reactor 14 separate liquid and gas streams.

The gaseous portion of the effluent, withdrawn from separator 16 through line 17, contains hydrogen, as well as impurities, such as carbon oxide(s), ammonia, hydrogen sulfide, and hydrocarbons. The gaseous portion in line 17 is passed through a pressure reduction valve, schematically generally indicated as 18 to reduce the pressure of the gas from a pressure in excess of 1000 psig to a lower pressure as hereinabove described, and generally a pressure not in excess of 800 psig. Although a single pressure reduction valve is shown, it is to be understood that the pressure reduction may be accomplished other than by the use of a single valve. Although the reduction in pressure is shown to be accomplished by a pressure reduction valve, it is to be understood that pressure reduction may be accomplished other than by the use of a valve. In addition, as previously noted, the pressure reduction could also be performed in multiple steps.

The liquid portion of the effluent is withdrawn from separator 16 through line 21, and such liquid portion is passed through a pressure reduction valve schematically generally indicated as 22 to reduce the pressure of the liquid to a pressure as hereinabove described with reference to the gas. In particular, the liquid portion of the effluent is reduced to a pressure essentially identical to the pressure to which the gaseous portion of the effluent is reduced in pressure reduction valve 18. As hereinabove described, such pressure reduction may be accomplished in stages or by means other than a valve.

As a result of the reduction of pressure, additional gas is released from the liquid, and a gas liquid mixture, at a reduced pressure, in line 23, is introduced into a combined separating stripping vessel, schematically generally indicated as 24. The vessel 24 is preferably provided with a stripping gas, such as steam, in line 25 to facilitate separation of hydrogen and light gases from the liquid. The vessel 24 is generally operated at a temperature at or near the temperature prevailing in the reactor; i.e., no external cooling of the liquid.

Flashed and stripped gases are withdrawn from vessel 24 through line 26, and combined with the gas from pressure reduction valve 18, in line 27.

The combined stream in line 28 is introduced into a cooling zone schematically generally indicated as 29 to cool the gas to a temperature in the order of from 250° F. to 600° F. to thereby condense a portion of the gas. A gas-liquid mixture is withdrawn from cooling zone 29 through line 31 and introduced into a combined separating stripping vessel, schematically generally indicated as 32. The vessel 32 is preferably provided with a stripping gas, such as steam, through line 33 so as to facilitate separation of hydrogen and light gases from the liquid The vessels 24 and 32 are in fact strippers (towers) provided with trays. Gas-liquid separation of the gas-liquid mixture, in lines 23 and 31, will take place in the top section of vessels 24 and 32, and stripping in the lower section.

The gaseous stream is withdrawn from vessel 32 through line 34, combined with water added through line 35 for the purpose of removing ammonia as soluble ammonium sulfide, and the combined stream is passed through an air cooler 36 and an indirect heat exchanger, schematically generally indicated as 37 to effect further cooling of the gas by indirect heat transfer (for example, cooling water). The cooling of the gas in coolers 36 and 37 results in additional condensation of impurities from the gas and also reduces hydrogen solubility in the condensed liquids, thereby reducing hydrogen loss.

The gas-liquid mixture in line 38 is introduced into a separator 39, to separate sour water which is withdrawn through line 41, and additional hydrocarbon materials which are withdrawn through line 42.

The liquid recovered from separator 39 through line 42 and the hydrocarbon liquids recovered from vessels 24 and 32 through lines 43 and 44, respectively, are introduced into a fractionating zone 45 for recovery of various liquid product fractions, and recycle streams, if required.

The gas withdrawn from separator 39 through line 51 is introduced into a hydrogen sulfide removal zone, schematically generally indicated as 52, of a type known in the art for removal of hydrogen sulfide. It is to be understood that, in some cases, a separate hydrogen sulfide removal zone is not required. For example, purification could be accomplished in a single zone.

The gas withdrawn from hydrogen sulfide removal zone 52, through line 53, generally contains from 60% to 90% of hydrogen, with the remainder of the gas being basically hydrocarbon impurities. The gas in line 53 is then introduced into a hydrogen purification zone 54, which as particularly shown, is a pressure swing adsorption zone of a type known in the art.

Hydrogen recycle gas, containing at least 70%, and preferably at least 90%, by volume, of hydrogen, and in most cases containing 99+% of hydrogen, withdrawn from zone 54 through line 55, is compressed in compressor 58 to the pressure prevailing in the hydrogenation reactor 14 and then combined with makeup hydrogen in line 56. The compressed gas in line 59 is heated to the proper temperature in hydrogen heater 61, and the heated gas in line 13 is combined with the hydrocarbon feed, as hereinabove described.

Although the invention has been described with reference to the particular embodiment illustrated in the drawing, it is to be understood that such embodiment may be modified within the spirit and scope of the present invention. Thus, for example, although the embodiment has been particularly described with respect to separating the gaseous and liquid portions of the effluent, prior to pressure reduction, it is also possible to reduce the pressure of the combined effluent, followed by separation of the gaseous and liquid portions at a lower pressure. In such a modification, the gas-liquid mixture in line 15, after reduction of pressure (for example, in a suitable pressure reduction valve), would be introduced into the separator 24, whereby separator 16, as well as the pressure reduction valves 18 and 22 would be eliminated.

Although the embodiment has been described with reference to recycling all of the hydrogen to the process from which the hydrogen is recovered, it is to be understood that all or a portion of the hydrogen can be used in another hydrogenation unit which is operated at an elevated pressure; i.e., of at least 1000 psig.

The above modification and others should be apparent to those skilled in the art from the teachings herein.

The invention will be described with respect to the following examples; however, the scope of the invention is not to be limited thereby:

EXAMPLE

A hydrogenation unit was set up to treat 40,000 BPSD of petroleum residuum (containing about 60%, by volume, of material boiling above 975° F.), with 41.3 mm SCFD of net hydrogen make-up containing 97% by volume of hydrogen. A combined hydrogen stream and a preheated petroleum residuum stream were introduced into a hydrogenation reactor of the expanded catalyst bed type operated at 2500 psig and 825° F. The gaseous and liquid portions of the effluent stream from the hydrogenation reactor were introduced into a gas-liquid separator, operating at substantially the temperature and pressure prevailing in the reactor. The gaseous portion of the effluent from the separator had the composition shown in Table A, under the indicated operating conditions.

The liquid portion of the effluent from the separator was introduced into a gas-liquid separator. Hydrogen and impurities were flashed and stripped from the liquid, and removed as a gas stream. The operating conditions and the composition of the gas stream and of the liquid product stream are shown in Tables A and B.

The gaseous portion of the effluent was reduced in pressure through a pressure reduction valve and was then combined with the gas stream. The combined stream was substantially at about 800° F. and 400 psig before being introduced into a cooling zone. Cooling yielded a gas-liquid mixture which was introduced into a separation zone.

Hydrogen and impurities were stripped from the liquid and were removed as a gas stream. The operating conditions and the composition of the gas stream and the liquid bottom product stream appear as are shown in Tables A and B.

Water was added to the gas stream prior to entering the air cooling zone, in order to dissolve ammonium sulfide. This prevents sublimation of ammonium sulfide and the consequent fouling of the cooling equipment. The cooling zone yeilds a three-phase mixture which is introduced into a separator, where three-phase separation takes place. The operating conditions and the composition of the gas stream and of the liquid effluent are shown in Tables A and B.

The gas stream was introduced into an acid gas removal zone to remove acid gas components. The stream cleared of acid gas was introduced into a hydrogen purification zone of the type based on the pressure swing adsorption principle. The hydrogen purification zone yielded a gas stream which was then compressed and combined with net hydrogen make-up to form the combined hydrogen feed stream to the reactor.

The operating conditions and composition of these gas streams are shown in Table A.

TABLE A

| COMPONENTS, VAPOR STREAM NO. (line in dwg.) | 13 Mol. % | 17 Mol. % | 26 Mol. % | 34 Mol. % | 51 Mol. % | 55 Mol. % |
|---|---|---|---|---|---|---|
| Hydrogen | 98.3 | 65.6 | 27.2 | 59.0 | 76.0 | 99.9 |

TABLE A-continued

| COMPONENTS, VAPOR STREAM NO. (line in dwg.) | 13 Mol. % | 17 Mol. % | 26 Mol. % | 34 Mol. % | 51 Mol. % | 55 Mol. % |
|---|---|---|---|---|---|---|
| Hydrogen Sulfide | | 9.6 | 6.6 | 9.3 | 10.0 | |
| Ammonia | | .8 | .3 | .7 | | |
| $H_2O$ | | 4.5 | 32.2 | 13.7 | .3 | |
| 1 through 4 carbon containing hydrocarbons | 1.7 | 10.9 | 8.6 | 10.8 | 12.9 | .1 |
| C5 to 400° F. boiling point hydrocarbons | | 5.6 | 11.5 | 5.8 | .8 | |
| 400° F. to 650° F. boiling point hydrocarbons | | 2.4 | 9.0 | .7 | | |
| 650° F. and higher boiling point hydrocarbons | | .6 | 4.6 | | | |
| Total | 100 | 100 | 100 | 100 | 100 | 100 |
| Temperature, °F. | | 825 | 822 | 400 | 100 | 100 |
| Pressure, PSIG | | 2450 | 400 | 370 | 350 | 340 |
| Lbs/Hr | 18300 | 115898 | 97694 | 117475 | 47699 | 7254 |
| MMSCF/D | 74.1 | 49.3 | 15.1 | 61.7 | 47.8 | 32.8 |

TABLE B

| COMPONENTS, LIQUID STREAM NO. (line in dwg.) | 12 Wt. % | 43 Wt. % | 44 Wt. % | 42 Wt. % |
|---|---|---|---|---|
| Hydrogen | | <10 ppm | <10 ppm | <350 ppm |
| Hydrogen Sulfide | | <10 ppm | <150 ppm | 3.7 |
| 1 through 4 carbon containing hydrocarbons | | <100 ppm | .1 | 5.0 |
| C5 to 400° F. boiling point hydrocarbons | | .7 | 12.2 | 73.6 |
| 400 to 650° F. boiling point hydrocarbons | | 7.1 | 49.7 | 17.2 |
| 650° F. and higher boiling point hydrocarbons | 100 | 92.2 | 38 | .5 |
| Total | 100 | 100 | 100 | 100 |
| Temperature, °F. | | 812 | 400 | 100 |
| Pressure, PSIG | | 405 | 375 | 350 |
| Lbs/Hr | 598110 | 412418 | 98717 | 50922 |
| BPSD | 40000 | 28598 | 7696 | 4597 |

The present invention is particularly advantageous in that it permits effective recovery of unreacted hydrogen from a hydrogenation process. As compared to the procedures of the prior art wherein unreacted hydrogen is recovered from the effluent at a high pressure, and maintained at such pressure for treatment and recycle to a hydrogenation process, there is a reduction in capital cost in that high pressure equipment is minimized. In addition, the vapors recovered from the liquid portion of the effluent by reduction of pressure and stripping may be combined with the gaseous portion of the effluent, which is at a reduced pressure, which eliminates the necessity for providing for dual vapor condensing trains.

In addition, the hydrogen recycle stream is of a higher purity which permits a reduction in total pressure for achieving the same hydrogen partial pressure. In addition, there is a reduction in the total gas to the reactor, which provides for an increased capacity for a given reactor area.

In addition, the total gas flow rate to the reactor can be reduced because of the higher hydrogen purity of the gas feed and this may permit designs of smaller reactors for a given reactor space velocity requirement.

As a further advantage, unreacted hydrogen gas that is dissolved in liquid effluent streams can be reduced to negligable levels, in particular where a stripping gas such as steam is employed.

The present invention is particularly advantageous as to the economics of potential hydrogen loss when the ratio of hydrogen introduced into the reactor to the hydrogen consumed in the reactor is not too high; e.g., 2 or less.

The above advantages and others should be apparent to those skilled in the art from the teachings herein.

Numerous modifications and variations of the present invention are possible in light of the above teachings and, therefore, within the scope of the appended claims, the invention may be practiced otherwise than as particularly described.

What is claimed is:

1. In a process for hydrogenating a hydrocarbon feed at a hydrogenation pressure of at least 1000 psig wherein a hydrogenation effluent comprising a liquid portion and a gaseous portion is recovered from the hydrogenation, said gaseous portion containing unreacted hydrogen and impurities, the improvement comprising:

(a) reducing the pressure of said gaseous portion from a hydrogenation pressure of at least 1000 psig to a lower pressure which is at least 200 psi less than the hydrogenation pressure and which is not in excess of 1500 psig to provide a gas containing hydrogen and impurities at a reduced pressure;

(b) removing impurities from gas from step (a) to provide a hydrogen gas containing at least 70%, by volume, of hydrogen; and (c) increasing the pressure of hydrogen gas from step (b) to an elevated pressure which is at least 1000 psig and which is at least 200 psi greater than the lower pressure for use in a hydrogenation process.

2. The process of claim 1 wherein the gaseous portion and liquid portion are in admixture with each other prior to and subsequent to reducing the pressure, and the gaseous portion is separated from the liquid portion prior to removing impurities from the gaseous portion.

3. The process claim 1 wherein the gaseous portion and liquid portion are separated from each other prior to reducing the pressure of the gaseous portion.

4. The process of claim 3 and further comprising:

reducing the pressure of the separated liquid portion to a pressure corresponding to the reduced pressure for the gaseous portion to release a further gaseous portion containing hydrogen therefrom; and recovering and combining the further gaseous portion with the gaseous portion to remove impurities from both the gaseous portion and the further gaseous portion at the reduced pressure.

5. In a process for hydrogenating a hydrocarbon feed at a hydrogenation pressure of at least 1000 psig, wherein a gas containing unreacted hydrogen and impurities is recovered at the hydrogenation pressure, the improvement comprising:

(a) reducing the pressure of the gas in at least one stage to a reduced pressure of no greater than 800 psig;

(b) removing impurities from gas from step (a) to produce a hydrogen gas containing at least 70%, by volume, of hydrogen; and (c) increasing the pressure of hydrogen gas from step (b) to a pressure of at least 1000 psig for use in a hydrogenation process.

6. The process of claim 5 wherein the reduced pressure is a pressure of from 150 to 600 psig.

7. The process of claim 6 wherein hydrogen gas contains at least 90%, by volume, of hydrogen.

8. The process of claim 7 wherein the hydrocarbon feed contains at least 25%, by volume, of material boiling above 950° F.

9. The process of claim 7 wherein the pressure of the hydrogen gas is increased to the hydrogenation pressure and the hydrogen gas at the hydrogenation pressure is recycled to the hydrogenation.

10. The process of claim 5 and further comprising: recovering a liquid effluent from the hydrogenation; reducing the pressure of the liquid effluent in at least one stage to a pressure essentially identical to the lower pressure of said gas;

recovering additional gas containing hydrogen and impurities from said liquid effluent at said lower pressure; and combining said additional gas with said gas to remove impurities from both the gas and additional gas at the lower pressure.

11. The process of claim 10 wherein the pressure of the gas and the liquid effluent are reduced as a combined stream of the gas and liquid effluent.

12. The process of claim 10 wherein the gas and liquid effluent from the hydrogenation are separated from each other prior to reducing the pressure.

13. The process of claim 12 wherein the hydrogen gas contains at least 90%, by volume, of hydrogen.

14. The process of claim 13 wherein the lower pressure is a pressure of from 150 to 600 psig.

15. The process of claim 14 wherein the hydrocarbon feed contains at least 25%, by volume, of material boiling above 950° F.

16. The process of claim 15 wherein the pressure of the hydrogen gas is increased to the hydrogenation pressure and the hydrogen gas at the hydrogenation pressure is recycled to the hydrogenation.

17. The process of claim 16 wherein the hydrogenation pressure is from 1800 to 3000 psig.

18. The process of claim 17 wherein the hydrocarbon feed is hydrogenated in an ebullated bed and said hydrocarbon feed contains at least 25%, by volume, of material boiling above 950° F.

19. The process of claim 16 wherein additional gas is stripped from the liquid effluent at the lower pressure.

20. In a process for hydrogenating a hydrocarbon feed with hydrogen gas at a hydrogenation pressure of at least 1000 psig wherein a hydrogenation effluent comprising a liquid portion and a gaseous portion is recovered from the hydrogenating, said gaseous portion and said liquid portion containing unreacted hydrogen, the improvement comprising:

(a) reducing the pressure of said gaseous portion from a hydrogenation pressure of at least 1000 psig to a reduced pressure which is at least 200 psi less than the hydrogenating pressure and which is not in excess of 1500 psig to provide a gas containing hydrogen and impurities at a reduced pressure;

(b) reducing the pressure of the liquid portion from a hydrogenating pressure of at least 1000 psig to a reduced pressure which is at least 200 psi less than the hydrogenating pressure and which is not in excess of 1500 psig to recover from the liquid portion a further gas containing hydrogen and impurities at a reduced pressure;

(c) removing impurities from gas from step (a) and further gas recovered from step (b) to provide a hydrogen gas containing at least 70%, by volume, of hydrogen;

(d) increasing the pressure of hydrogen gas from step (c) to the hydrogenation pressure; and (e) employing gas from step (d) in the process for hydrogenating a hydrocarbon feed.

21. The process of claim 20 wherein the reduced pressure in steps (a) and (b) is no greater than 800 psig.

22. The process of claim 21 wherein in step (c) the impurities are removed to provide a hydrogen gas containing at least 90%, by volume, of hydrogen.

23. The process of claim 22 wherein the hydrogen gas from step (c) contains at least 99%, by volume, of hydrogen.

24. The process of claim 22 wherein the hydrogenating of hydrocarbon is effected in an expanded bed at a temperature of from 650° F. to 900° F., said hydrocarbon feed having at least 25% by volume, of material boiling above 950° F.

25. The process of claim 24 wherein the hydrocarbon feed is a tar sand bitumen.

26. The process of claim 25 wherein the reduced pressure is from 150 to 600 psig.

27. The process of claim 24 wherein the ratio of hydrogen introduced into the hydrogenating to hydrogen consumed in the hydrogenating is no greater than 2.

28. The process of claim 24 wherein impurities in step (c) are removed by pressure swing adsorption.

* * * * *